US006832846B2

(12) United States Patent
Lagonegro

(10) Patent No.: US 6,832,846 B2
(45) Date of Patent: Dec. 21, 2004

(54) TRACK LIGHTING ATTACHMENT

(76) Inventor: Sean P. Lagonegro, 700 E. Walnut, Burbank, CA (US) 91501

( * ) Notice: Subject to any disclaimer, the term of this patent is extended or adjusted under 35 U.S.C. 154(b) by 100 days.

(21) Appl. No.: 10/274,726

(22) Filed: Oct. 15, 2002

(65) Prior Publication Data

US 2004/0070982 A1 Apr. 15, 2004

(51) Int. Cl.[7] ..... F21V 21/08
(52) U.S. Cl. ..... 362/359; 362/457
(58) Field of Search ..... 362/359, 433, 362/449, 451, 453, 457, 275

(56) References Cited

U.S. PATENT DOCUMENTS

| | | | | |
|---|---|---|---|---|
| 1,540,476 A | | 6/1925 | Hoffman et al. | |
| 2,232,471 A | | 2/1941 | Powell | 240/48.4 |
| 3,305,681 A | * | 2/1967 | Green | 362/275 |
| 4,310,875 A | | 1/1982 | Price | 362/277 |
| 5,075,828 A | | 12/1991 | Gordin et al. | 362/297 |
| 5,211,473 A | | 5/1993 | Gordin et al. | 362/297 |
| 5,230,559 A | | 7/1993 | Porter et al. | 362/153.1 |
| 5,730,521 A | | 3/1998 | Spink et al. | 362/217 |
| 6,106,134 A | | 8/2000 | Bomas | 362/153.1 |
| 6,152,578 A | | 11/2000 | Hoffman et al. | 362/285 |
| 6,497,501 B1 | * | 12/2002 | Harder | 362/359 |

* cited by examiner

*Primary Examiner*—Stephen F Husar

(57) ABSTRACT

A track lighting attachment for effectively directing light emitted from a track light and reducing the light wash. The track lighting attachment includes a cylinder member, a first aperture and a second aperture within the cylinder member, a first clip member positionable within the first aperture and a second clip member positionable within the second aperture. The first clip member and the second clip member are formed to engage the outer lip portion of a light unit of the track lighting system. The light emitted from the light unit thereby directed through the lumen of the cylinder member thereby focusing the light beam upon a specific location and reducing the light wash.

20 Claims, 9 Drawing Sheets

TRACK LIGHTING ATTACHMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to track lighting and more specifically it relates to a track lighting attachment for effectively directing light emitted from a track light and reducing the light wash.

2. Description of the Related Art

Track lighting systems have been in use for years. A conventional track lighting system is comprised of an elongate track, a base unit slidable within the elongate track and electrically connectable within the elongate track, and at least one light unit attached to the base unit for emitting a light beam. The light units may or may not have a casing surrounding a light bulb. Some light units have a tubular structure for directing the light upon a specific object.

However, light units that do not have a tubular structure or an outer casing tend to emit the light over a relatively broad area which is desirable in certain applications. In some applications it is desirable to change the lighting pattern from broad application to a narrow, focused application. Unfortunately, to accomplish this the user must purchase new light units that direct and focus the light upon a specific location which can be costly and time consuming. There is therefore a need for a product that can be added to existing light units for focusing the light and minimizing the light wash.

Examples of patented devices which may be related to the present invention include U.S. Pat. No. 4,310,875 to Price; U.S. Pat. No. 6,152,578 to Hoffman et al.; U.S. Pat. No. 2,232,471 to Powell; U.S. Pat. No. 6,106,134 to Bomas; U.S. Pat. No. 5,730,521 to Spink et al.; U.S. Pat. No. 5,230,559 to Porter et al.; U.S. Pat. No. 5,211,473 to Gordin et al.; U.S. Pat. No. 5,075,828 to Gordin et al.; and U.S. Pat. No. 1,540,476 to Hoffman et al.

While these devices may be suitable for the particular purpose to which they address, they are not as suitable for effectively directing light emitted from a track light and reducing the light wash. Conventional track lights with broad light emission are not capable of focusing the light when desired without the purchase of a new light unit.

In these respects, the track lighting attachment according to the present invention substantially departs from the conventional concepts and designs of the prior art, and in so doing provides an apparatus primarily developed for the purpose of effectively directing light emitted from a track light and reducing the light wash.

BRIEF SUMMARY OF THE INVENTION

In view of the foregoing disadvantages inherent in the known types of track lighting systems now present in the prior art, the present invention provides a new track lighting attachment construction wherein the same can be utilized for effectively directing light emitted from a track light and reducing the light wash.

The general purpose of the present invention, which will be described subsequently in greater detail, is to provide a new track lighting attachment that has many of the advantages of the track lighting systems mentioned heretofore and many novel features that result in a new track lighting attachment which is not anticipated, rendered obvious, suggested, or even implied by any of the prior art track lighting systems, either alone or in any combination thereof.

To attain this, the present invention generally comprises a cylinder member, a first aperture and a second aperture within the cylinder member, a first clip member positionable within the first aperture and a second clip member positionable within the second aperture. The first clip member and the second clip member are formed to engage the outer lip portion of a light unit of the track lighting system. The light emitted from the light unit thereby directed through the lumen of the cylinder member thereby focusing the light beam upon a specific location and reducing the light wash.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a track lighting attachment that will overcome the shortcomings of the prior art devices.

A second object is to provide a track lighting attachment for effectively directing light emitted from a track light and reducing the light wash.

Another object is to provide a track lighting attachment that may be added to various conventional light units utilized within track lighting systems.

An additional object is to provide a track lighting attachment that may be easily attached or removed from a light unit.

A further object is to provide a track lighting attachment that directs light to a specific object.

Another object is to provide a track lighting attachment that is cost effective and relatively inexpensive.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
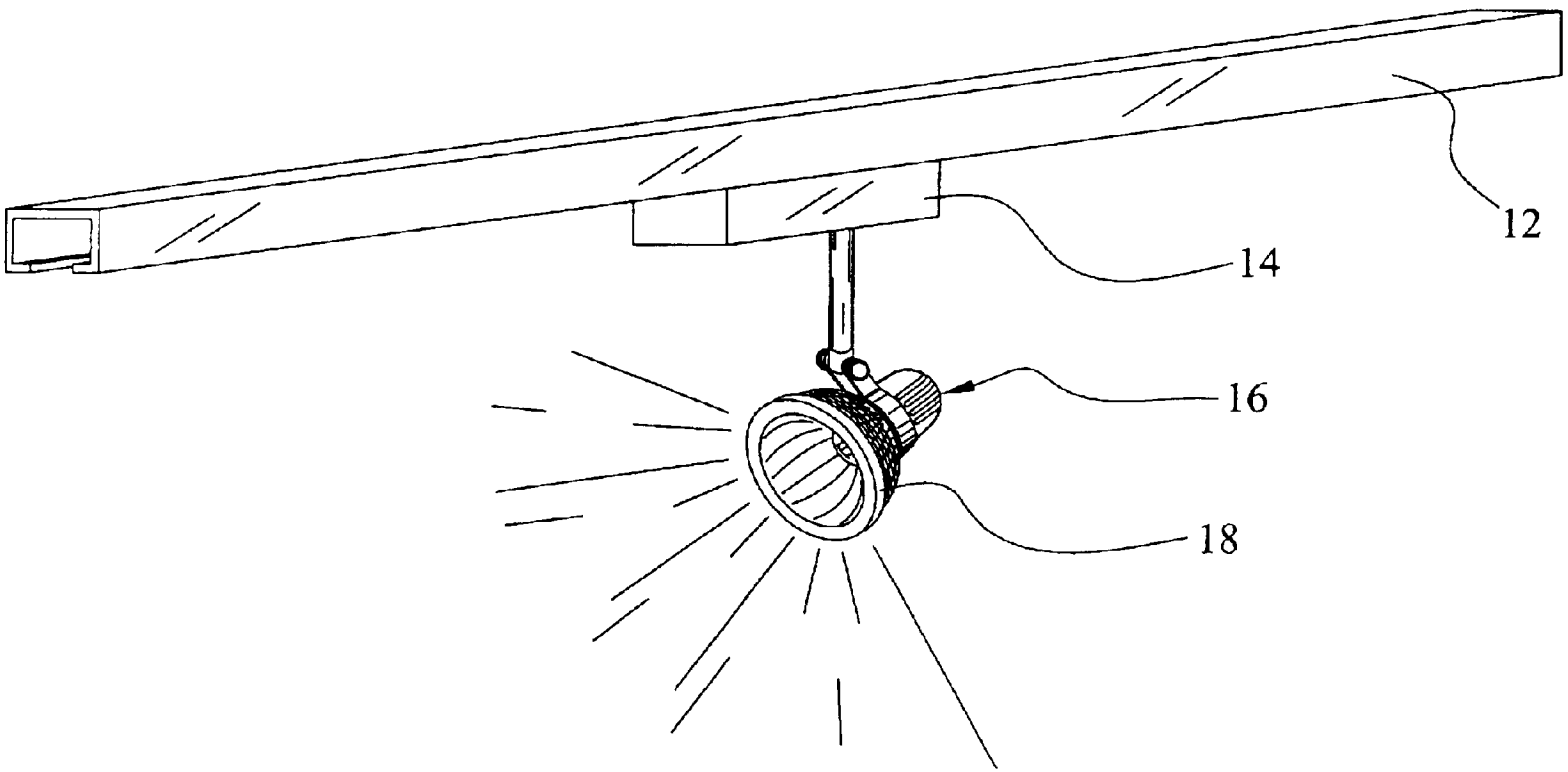
Fig. 1 (Prior Art)
FIG. 1 is an upper perspective view of a prior art track lighting system.
Figure 2:
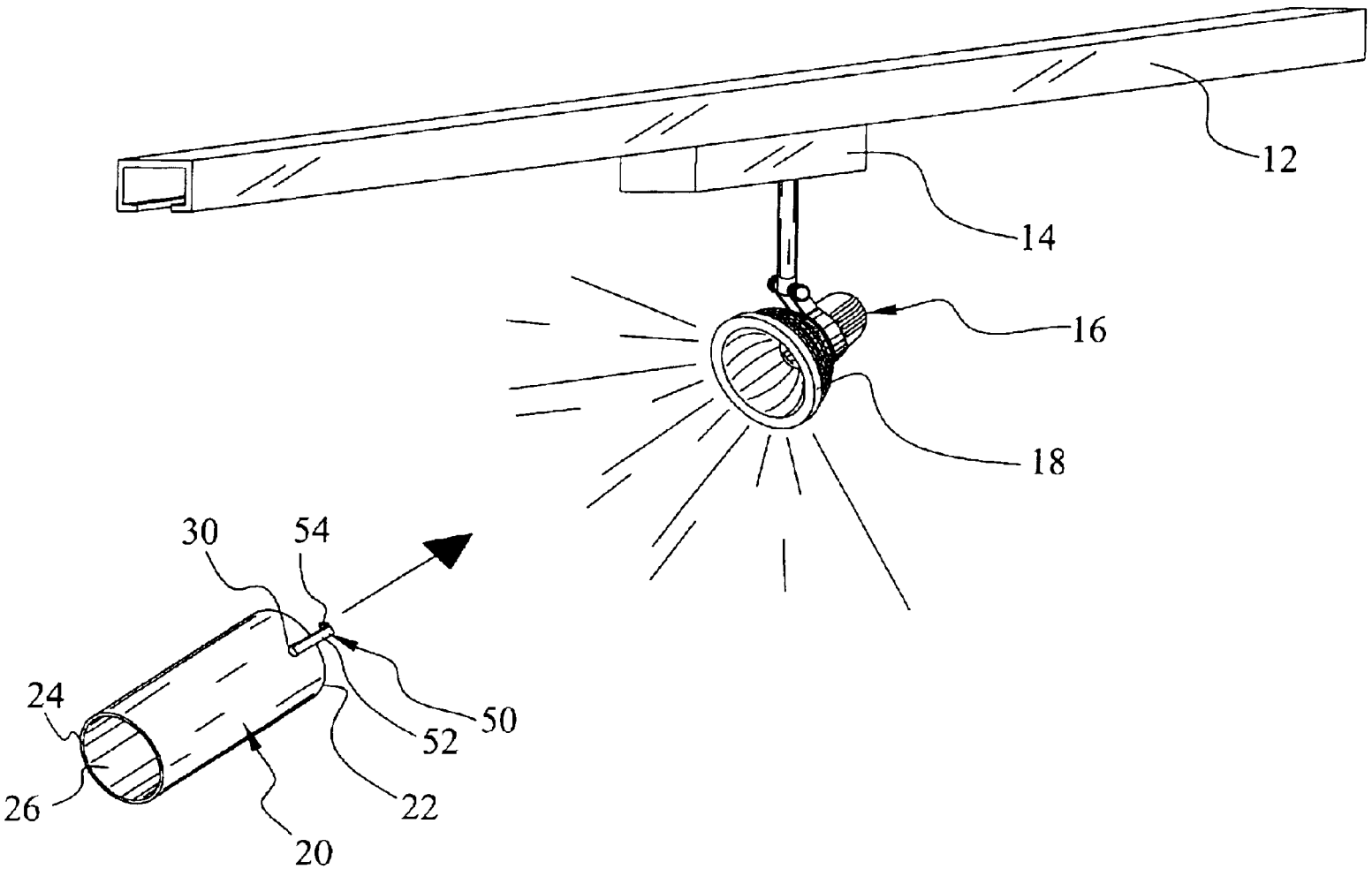
FIG. 2 is an exploded upper perspective view of the present invention with respect to the track lighting system.

Turning now descriptively to the drawings, in which similar reference characters denote similar elements throughout the several views, FIGS. 2 through 9 illustrate a track lighting attachment 10, which comprises a cylinder member 20, a first aperture 30 and a second aperture 40 within the cylinder member 20, a first clip member 50 positionable within the first aperture 30 and a second clip member 60 positionable within the second aperture 40. The first clip member 50 and the second clip member 60 are formed to engage the outer lip portion 18 of a light unit 16 of the track lighting system. The light emitted from the light unit 16 thereby directed through the lumen 26 of the cylinder member 20 thereby focusing the light beam upon a specific location and reducing the light wash.

As shown in FIGS. 2 through 8 of the drawings, the cylinder member 20 has an elongate tubular structure, a first end 22 and a second end 24. The cylinder member 20 preferably has a circular cross sectional shape, however various other shapes may be utilized as desired. The cylinder member 20 may have various lengths and diameters as desired to accommodate various corresponding sizes of light units 16.

The cylinder member 20 preferably has a length at least greater than 2 inches and a diameter at least greater than 0.5 inches. The cylinder member 20 may be comprised of various materials such as but not limited to metal, plastic, glass and the like. The lumen 26 of the cylinder member 20 is preferably non-reflective and may have a coating applied for reducing the reflective qualities of the material utilized to construct the cylinder member 20.

Figure 5:
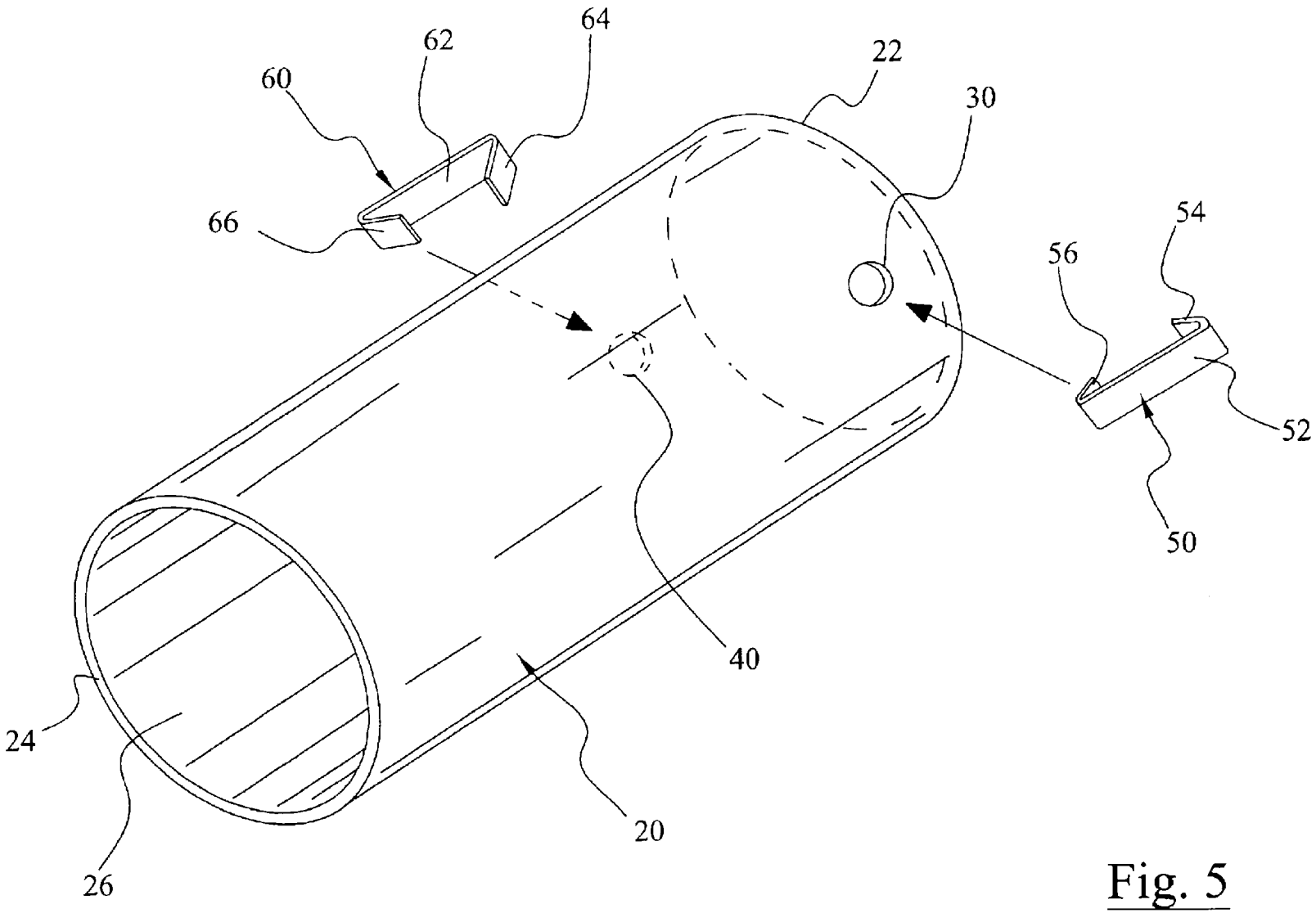
FIG. 5 is an exploded upper perspective view of the present invention.
Figure 6:
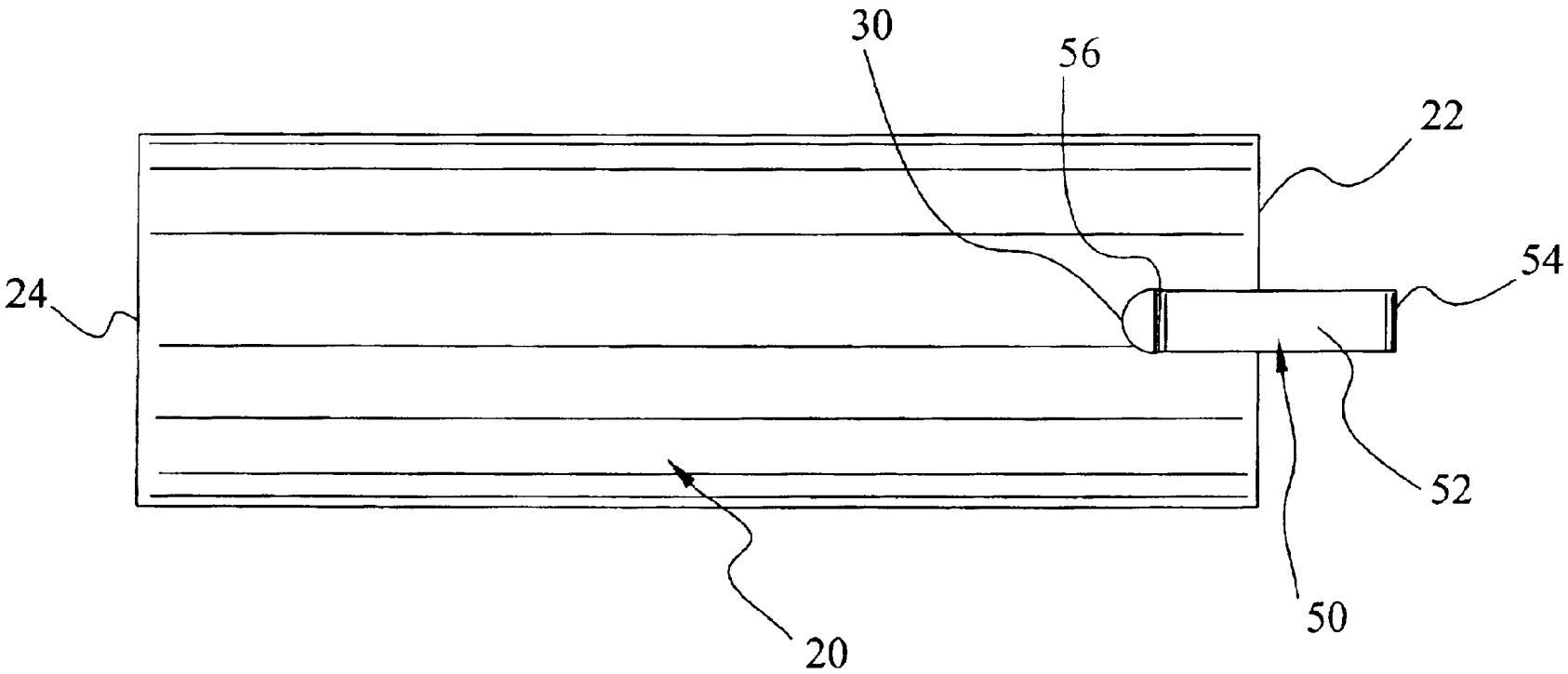
FIG. 6 is a side view of the present invention.
Figure 7:
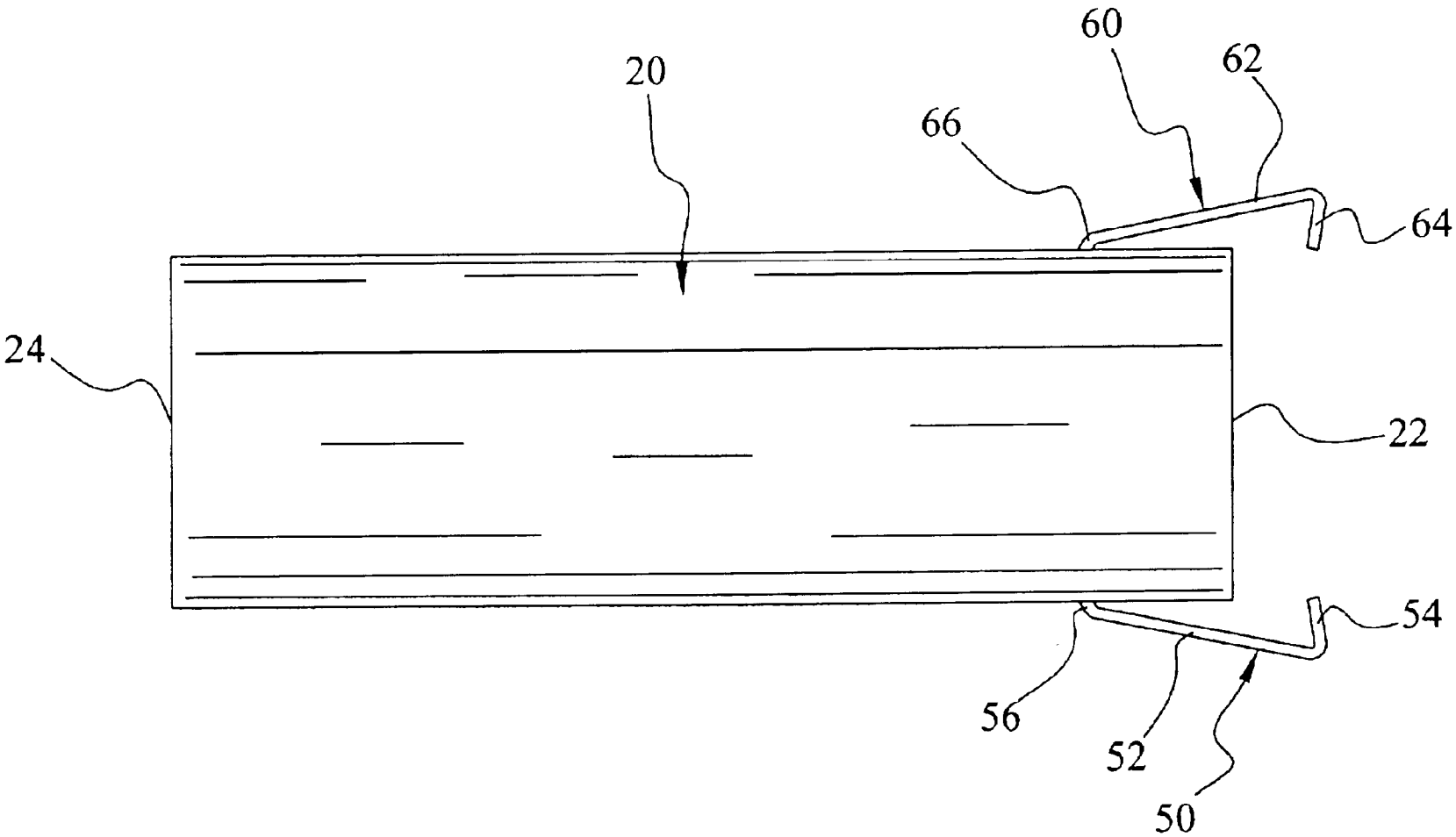
FIG. 7 is a top view of the present invention.

A first aperture 30 and a second aperture 40 extend within the side wall of the cylinder member 20 near the first end 22 as illustrated in FIG. 5 of the drawings. The first aperture 30 and the second aperture 40 preferably are aligned concentrically with one another, however the apertures 30, 40 may be aligned in various other manners.

The first aperture 30 and the second aperture 40 are formed for receiving the first clip member 50 and the second clip member 60 respectively. It can be appreciated that additional apertures may be positioned within the cylinder member 20 if additional clip members are desired to be utilized. The first aperture 30 and the second aperture 40 are preferably circular in shape, however various other shapes may be utilized.

As best illustrated in FIG. 5 of the drawings, the first clip member 50 is comprised of a first middle portion 52, a first outer jaw 54 extending from one end of the first middle portion 52 and a first inner jaw 56 extending from the opposing end of the first middle portion 52. The first inner jaw 56 is formed to extend through the corresponding first aperture 30 and be relatively tightly retained within the first aperture 30. The first outer jaw 54 is formed to catchably engage about the outer lip portion 18 of the light unit 16 of the track lighting system.

As best illustrated in FIG. 5 of the drawings, the second clip member 60 is comprised of a second middle portion 62, a second outer jaw 64 extending from one end of the second middle portion 62 and a second inner jaw 66 extending from the opposing end of the second middle portion 62 similar to the first clip member 50. The second inner jaw 66 is formed to extend through the corresponding second aperture 40 and be relatively tightly retained within the second aperture 40. The second outer jaw 64 is formed to catchably engage about the outer lip portion 18 of the light unit 16 of the track lighting system. The first clip member 50 and the second clip member 60 are preferably comprised of a resilient material such as but not limited to spring steel.

Figure 3:
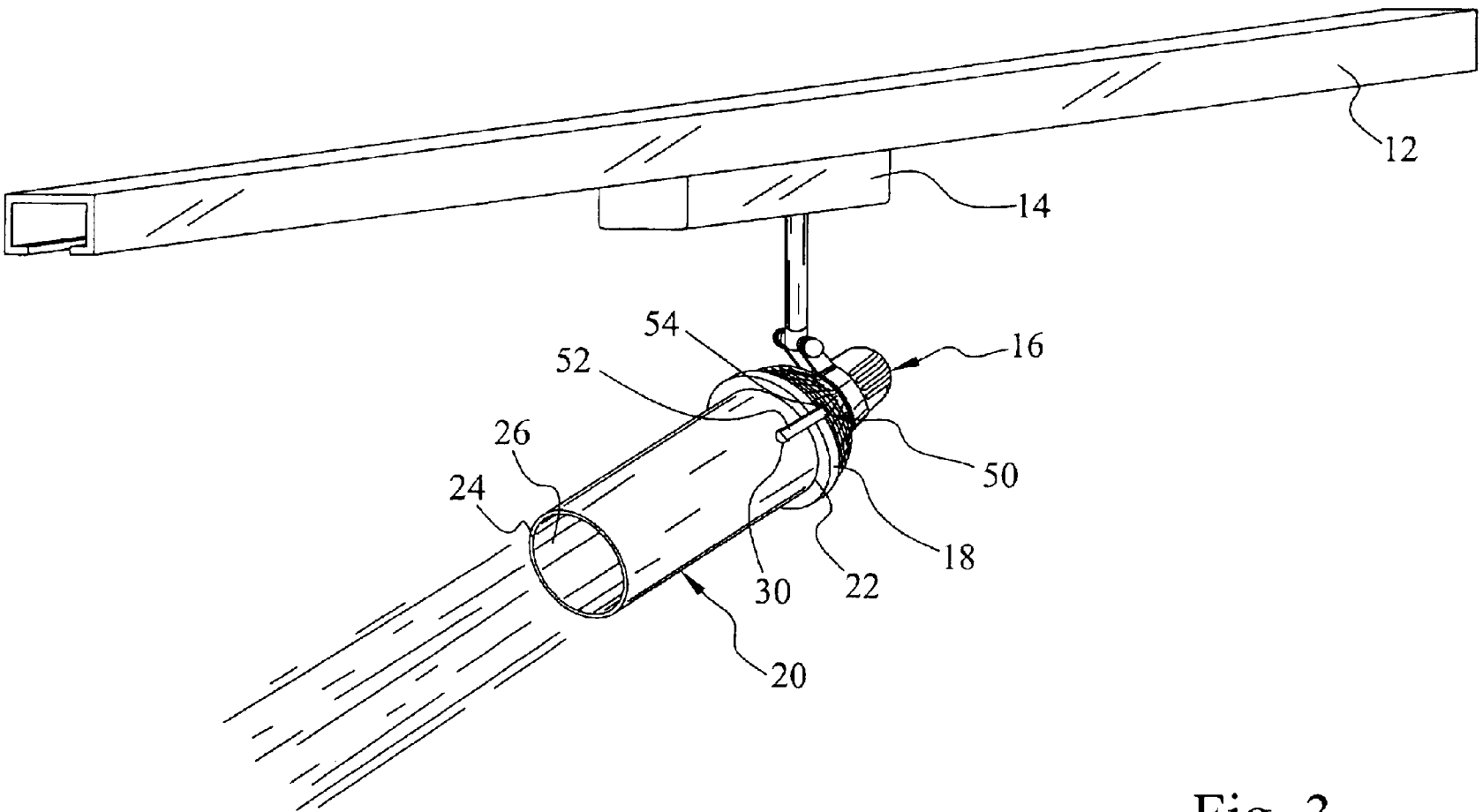
FIG. 3 is an upper perspective view of the present invention attached to the light unit of the track lighting system.
Figure 4:
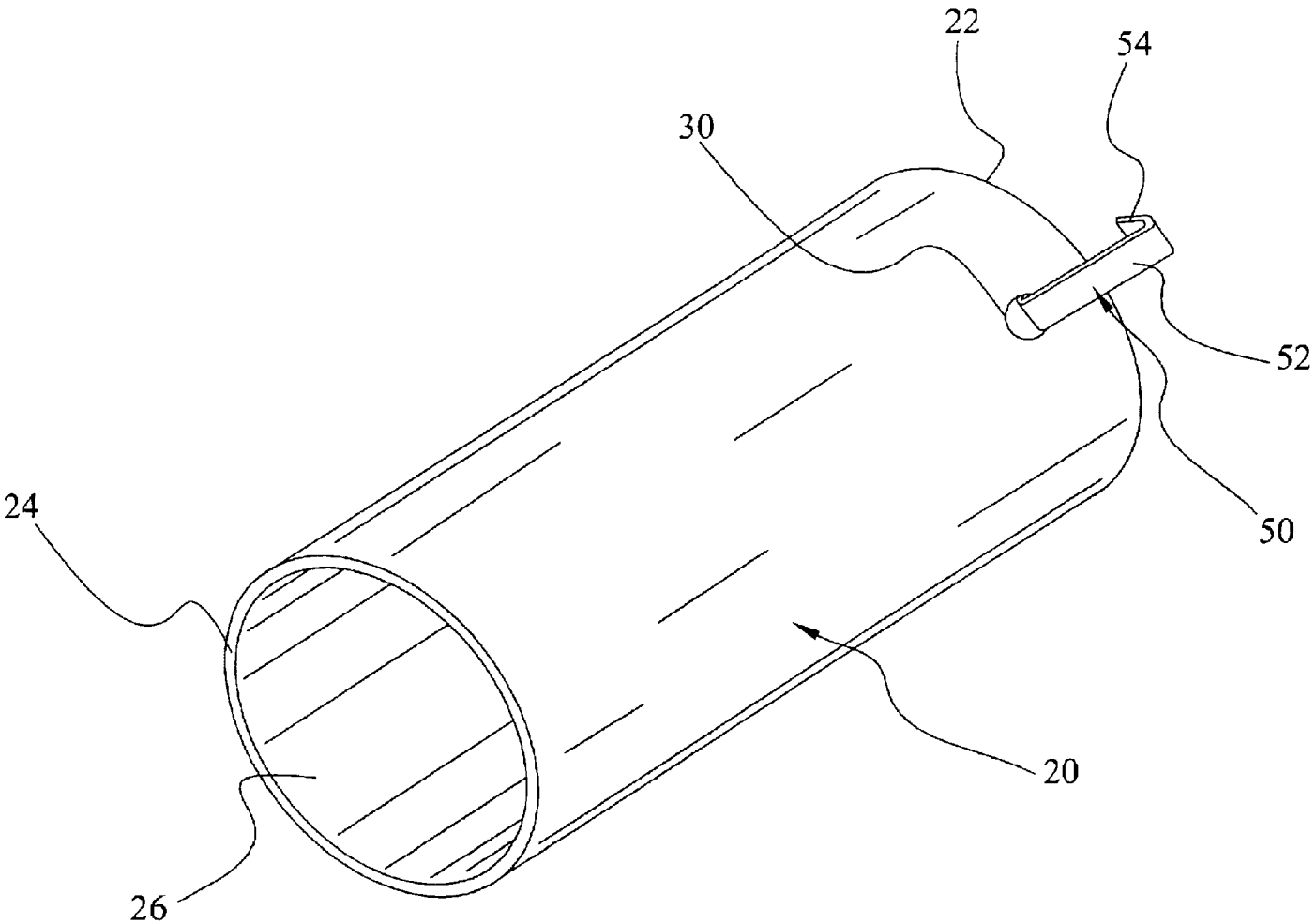
FIG. 4 is an upper perspective view of the present invention.
Figure 8:
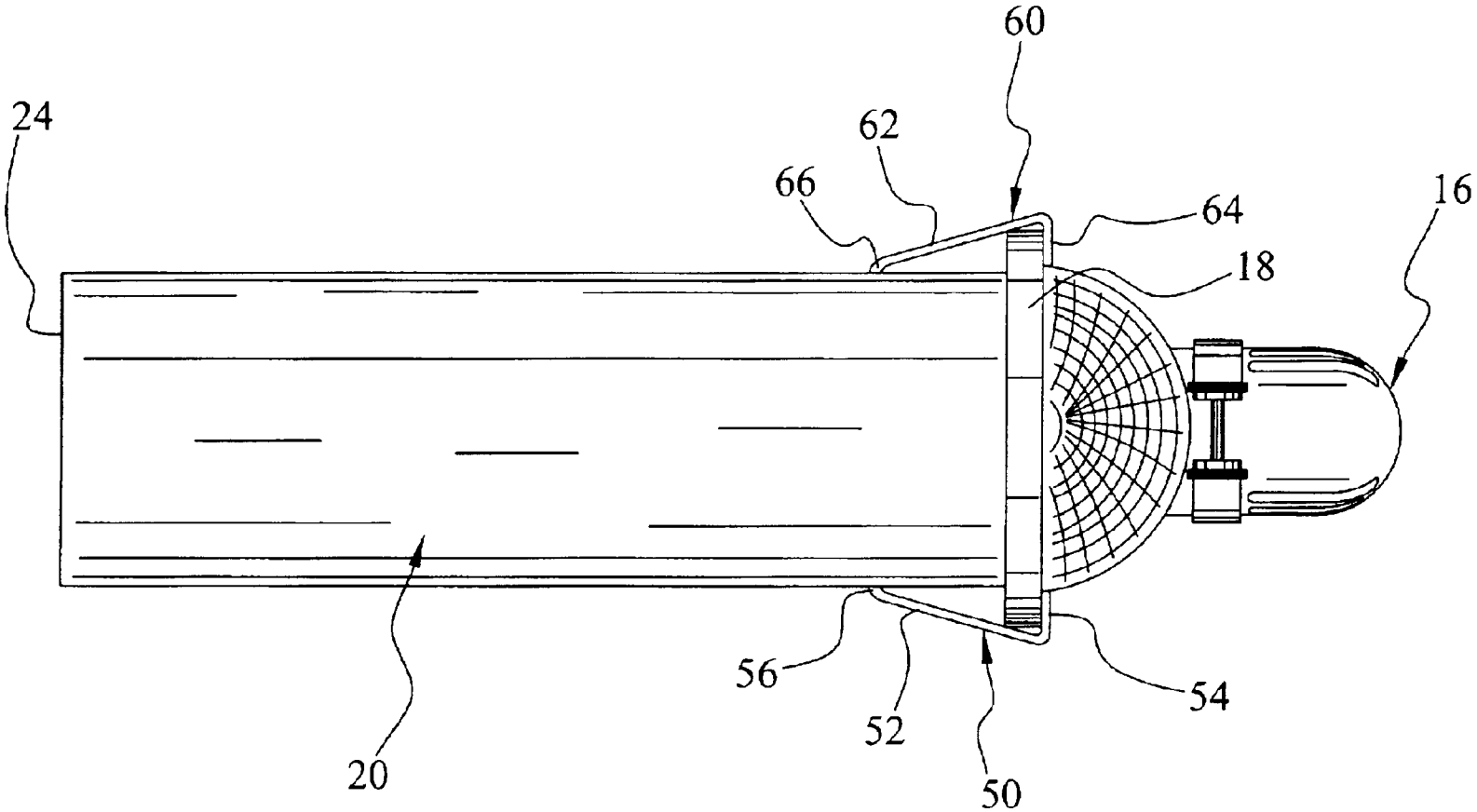
FIG. 8 is a top view of the present invention attached to the light unit.
Figure 9:
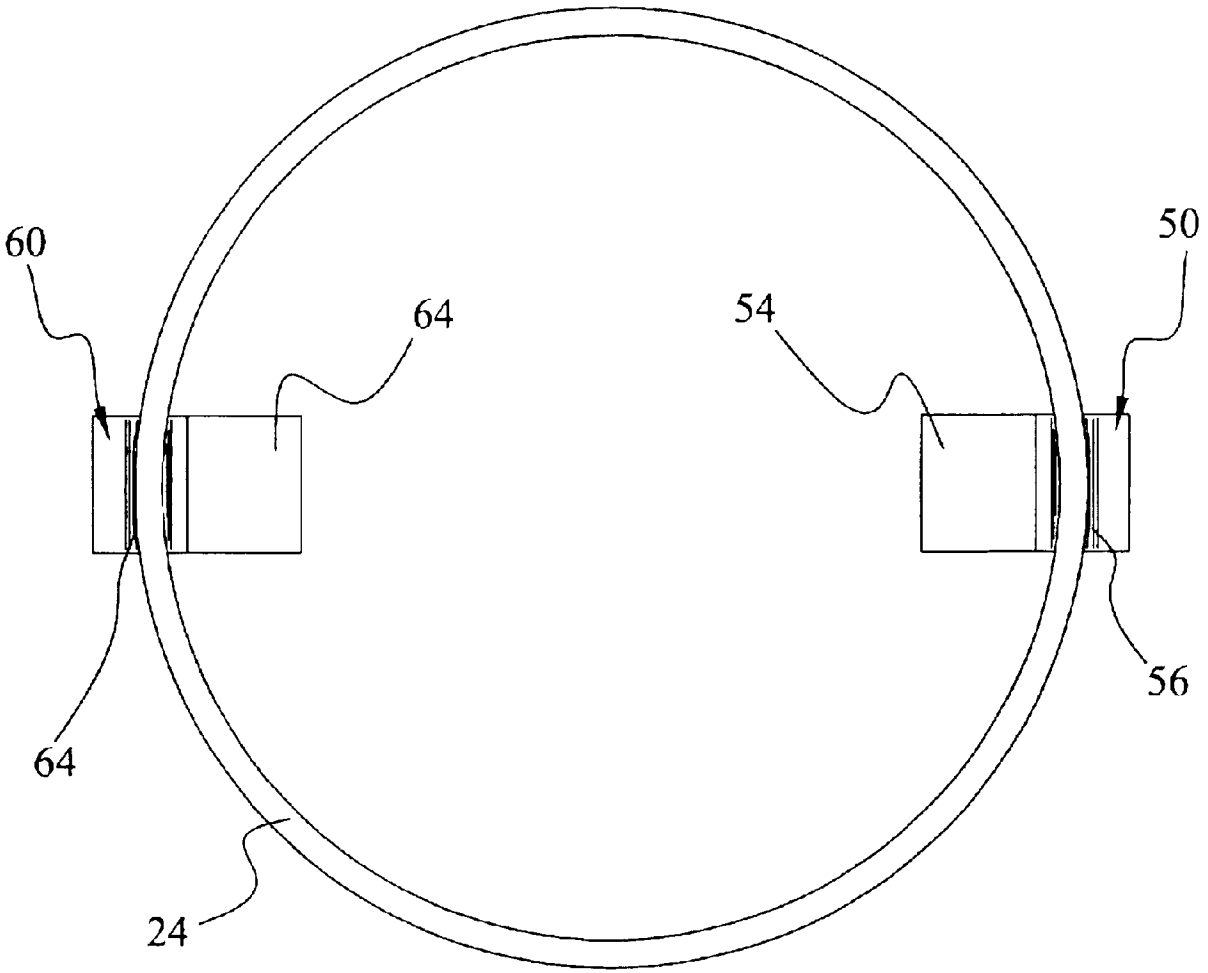
FIG. 9 is a front end view of the present invention.

In use, the first clip member 50 is positioned within the first aperture 30 and the second clip member 60 is positioned within the second aperture 40 with the respective inner jaw 56, 66 engaging the interior wall of the cylinder member 20. The track light system includes an elongate track 12, a base member 14 attached to the elongate track 12 and at least one light unit 16 attached to the base unit. The light unit 16 typically includes an outer lip portion 18 about the front portion thereof. The user positions the first end 22 of the cylinder member 20 adjacent to the front end of the light unit 16 and expands the clip members 50, 60 outwardly to fit about the outer lip portion 18 of the light unit 16. The user then releases the clip members 50, 60 which then catchably grip the outer lip portion 18 as illustrated in FIGS. 3 and 8 of the drawings. When the light unit 16 is illuminated, the light beam is directed through the lumen 26 of the cylinder member 20 thereby focusing the light beam emitted from the second end 24 of the cylinder member 20 while also reducing the light wash. If the user desires to return the light unit 16 to a broad light emission, the user simply removes the clip members 50, 60 from the outer lip portion 18 which allows for removal of the track lighting attachment 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A track lighting attachment for focusing light emitted from a light unit, comprising:

a cylinder member having a lumen, a first end and a second end;

a plurality of apertures extending through a side wall of said cylinder member near said first end; and a plurality of clip members positionable within said plurality of apertures for engaging an outer lip portion of a light unit.

2. The track lighting attachment of claim 1, wherein said plurality of clip members are comprised of a resilient material.

3. The track lighting attachment of claim 1, wherein each of said plurality of clip members is comprised of a middle portion, a first inner jaw positionable within said plurality of apertures and an outer jaw for catchably engaging an outer lip portion of a light unit.

4. The track lighting attachment of claim 3, wherein said inner jaw is angled at an acute angle with respect to said middle portion.

5. The track lighting attachment of claim 1, wherein said plurality of apertures are comprised of a first aperture and a second aperture.

6. The track lighting attachment of claim 5, wherein said first aperture and said second aperture are concentrically aligned with one another.

7. The track lighting attachment of claim 1, wherein said cylinder member is comprised of a elongate structure having a circular cross section.

8. The track lighting attachment of claim 1, wherein said cylinder member has a length of at least 2 inches.

9. The track lighting attachment of claim 1, wherein said cylinder member has diameter of at least 1 inch.

10. The track lighting attachment of claim 1, wherein said lumen of said cylinder member is non-reflective.

11. A track lighting attachment for focusing light emitted from a light unit, comprising:

a cylinder member having a lumen, a first end and a second end, wherein said lumen is smaller in size than a light unit to be attached thereto; and a plurality of clip members attached to an external portion of said cylinder member near said first end and extending outwardly at an angle from said cylinder member for engaging an outer lip portion of a light unit.

12. The track lighting attachment of claim 11, wherein said plurality of clip members are comprised of a resilient material.

13. The track lighting attachment of claim 11, wherein each of said plurality of clip members is comprised of a middle portion, and an outer jaw for catchably engaging an outer lip portion of a light unit.

14. The track lighting attachment of claim 13, wherein said outer jaw is angled at an acute angle with respect to said middle portion.

15. The track lighting attachment of claim 11, wherein said cylinder member is comprised of a elongate structure having a circular cross section.

16. The track lighting attachment of claim 11, wherein said cylinder member has a length of at least 2 inches.

17. The truck lighting attachment of claim 11, wherein said cylinder member has diameter of at least 1 inch.

18. The track lighting attachment of claim 11, wherein said lumen of said cylinder member is non-reflective.

19. A track lighting attachment for focusing light emitted from a light unit, comprising:

a cylinder member having a lumen, a first end and a second end, wherein said lumen is smaller in size than a light unit to be attached thereto, and wherein said cylinder member is comprised of a elongate structure having a circular cross section;

a plurality of clip members attached to an external portion of said cylinder member near said first end and extending outwardly at an angle from said cylinder member for engaging an outer lip portion of a light unit, wherein said plurality of clip members are comprised of a resilient material; and wherein each of said plurality of clip members is comprised of a middle portion, and an outer jaw for catchably engaging an outer lip portion of a light unit, wherein said outer jaw is angled at an acute angle with respect to said middle portion.

20. The track lighting attachment of claim 19, wherein said cylinder member has a length of at least 2 inches.

* * * * *